United States Patent [19]

Cacho

[11] 4,234,766

[45] Nov. 18, 1980

[54] SPEAKER ASSEMBLY

[76] Inventor: Gibson C. Cacho, 4006 Dorsey Rd.-Lot C, Charleston, S.C. 29405

[21] Appl. No.: 9,643

[22] Filed: Feb. 5, 1979

[51] Int. Cl.[3] ..... H04R 9/02; H04R 9/06; G10K 13/00

[52] U.S. Cl. ..... 179/115.5 R; 179/117; 181/171

[58] Field of Search ..... 179/1 E, 1 PC, 1 VE, 179/115.5 R, 117; 181/171, 179, 198, 199

[56] References Cited

U.S. PATENT DOCUMENTS

| | | | |
|---|---|---|---|
| 1,852,415 | 4/1932 | Jensen | 179/115.5 R |
| 2,469,773 | 5/1949 | Knowles | 181/171 |
| 2,642,028 | 6/1953 | Johnson | 181/171 |
| 2,756,281 | 7/1956 | Pittinger | 179/115.5 R |
| 2,770,681 | 11/1956 | Perry | 179/115.5 R |
| 3,356,796 | 12/1967 | Wray | 179/115.5 R |
| 3,462,559 | 8/1969 | Wilder | 179/115.5 R |
| 3,835,256 | 9/1974 | Wieder | 179/1 E |
| 4,013,846 | 3/1977 | Krawczak et al. | 179/115.5 R |

*Primary Examiner*—Daryl W. Cook
*Attorney, Agent, or Firm*—James J. Conlon

[57] ABSTRACT

A two-piece speaker assembly has a speaker base for permanent attachment to a cabinet and a detachable cone unit that may be removably attached to the base and replaced by a larger or smaller capacity speaker as desired. The separable base and cone units are threaded or provided with a bayonet-type of interlocking arrangement and biased with a spring to maintain a locked connection. Also, an electrical connection between the base and speaker cone is provided by a suitably-sized, contact-type of spring-biased terminals.

5 Claims, 3 Drawing Figures

FIG. 1
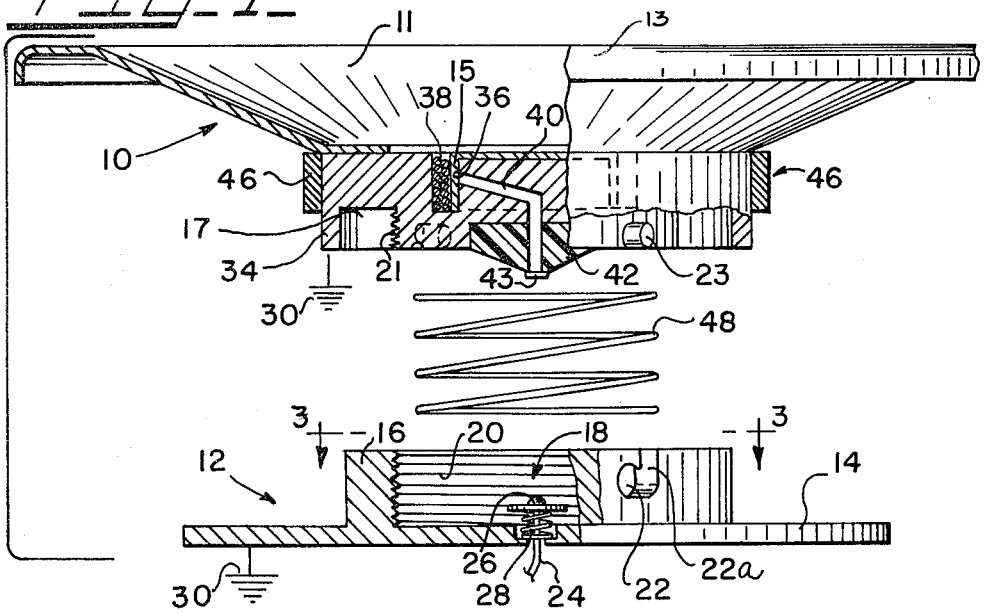
FIG. 2
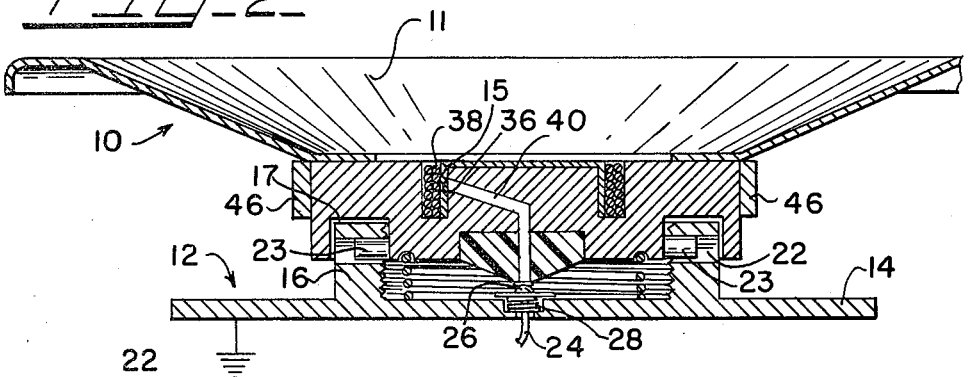
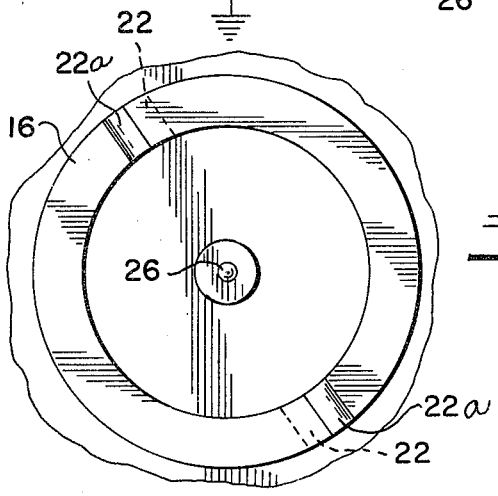
FIG. 3

SPEAKER ASSEMBLY

BACKGROUND OF THE INVENTION

1. Field of the Invention

This invention pertains to a speaker assembly which may be taken apart in order that a higher capacity or smaller capacity speaker cone may be used without the necessity of replacing the base and disassembling speaker housing and cabinet.

2. Description of the Prior Art

Prior art speaker assemblies generally include a one-piece speaker base and cone unit. Speakers are generally mounted in a cabinet and provided with suitable acoustical members such as reflectors, sound absorbers and sound directors and the like which are arranged in such a fashion that in the event it is desirable to change a speaker unit, the entire cabinet, speaker arrangement must be replaced. This disclosure provides a two-piece speaker unit wherein speaker includes a base which may be securely mounted in a cabinet, and, a cone which is removably attached to the base. Thus, when it is desirable to increase or reduce the capacity of the speaker, all is necessary is that the cone be removed from the base and the new cone element inserted.

SUMMARY OF THE INVENTION

As is well known, any stress system is only as good as the speakers which are used. Frequently, audiophiles will attempt to upgrade a sound system by the addition of better quality speakers. The cost of such upgrading is oftentimes prohibitive because entire speaker units and cabinets must be replaced. Occasionally, speaker cones which are paper, are damaged in handling or damaged by vandals, small children or the passage of time and use.

This disclosure relates to a two-piece speaker arrangement wherein a permanently attached speaker base has a cone unit removably attached thereto. In the event it is desirable to replace or change the speaker capacity, the detachable cone may be easily removed from the base.

In operation, the base and cone units are provided with cooperating threaded portions to allow the cone to be screwed into the base. Similarly, the base and cone units may include a so-called bayonet-type arrangement whereby a finger fits into a suitably-sized vertical slot and horizontal groove and may be easily attached and/or removed from the base unit.

A biasing spring placed between the base and cone insures that the two units remain in an assembled, secure fit after the initial assembly. Further, a spring-biased contact is centrally located in the base unit and cooperates with a suitably placed contact in the cone unit to complete the electrical connection between the contact and the voice coil.

Thus, it is an object of this invention to provide a speaker assembly for the use in radios, televisions, stereos and the like in which the capacity of the speaker may be altered by simply removing a detachable speaker cone and replacing with a different sized speaker cone unit.

Another object of this disclosure is to provide a speaker assembly having a cone unit that may be threaded onto a permanently mounted base unit and easily removed in the event it is desirable to change the capacity of the speaker or to replace a damaged speaker.

A further object of this disclosure is to provide a two-piece speaker assembly which may be easily taken apart and which includes spring biasing means urging the cone and base units into a secured, locked configuration when they are assembled.

Yet another object of this invention is to provide a speaker having a cone unit and a base unit and being interconnected by a bayonet-type of assembly wherein horizontally extending fingers cooperate with vertical slots and horizontally disposed grooves to align and lock the base and cone together as a single unit.

These and other objects of the invention will become apparent to those having ordinary skill in the art with reference to the following description, drawings and appended claims.

DESCRIPTION OF THE DRAWINGS

FIG. 1 is an exploded, elevantional view showing a two-piece speaker arrangement;

FIG. 2 is a sectional view of the assembled speaker elements; and

FIG. 3 is a view taken generally along the lines 3—3 of FIG. 1.

DESCRIPTION

Referring now to the drawings and in particular to FIG. 1, there is shown a cone unit 10 which is attachable to a rigidly mounted base unit 12. Cone unit 10 provides a paper diaphragm 11 which is attached at its periphery to frame 13 and attached at the rear base of its central portion to a coil carrier 15. Coil carrier 15 is a cylindrical member having a bottom attached to diaphragm 11. Base 12 includes a mounting flange 14 in which a number of openings are generally provided for fastening the base 12 into a speaker cabinet or speaker support such as the underside of an automobile dashboard. The central portion of the base 12 includes a housing 16 which is a circular member surrounding a centrally disposed cavity 18. As shown in FIGS. 1 and 2, the cavity 18 may include suitably sized internal threads 20, 21 or may include a bayonet-type of horizontal groove 22 and vertical slot arrangement designated 22*a*. In FIGS. 1 and 2 the threaded-type connection is shown on the left and the bayonet-type connection is shown on the right. Either arrangement may be used alone. It is not contemplated that both arrangements be used together.

The circular housing 16 is of a relatively large diameter because the threads or bayonet-type connection is more effective and easily attached when the connecting or mating portions are spaced apart as far as possible. With such spacing, dimensional variations in the mating parts produce only a minimum amount of misalignment.

As with any speaker arrangement, it is necessary that an electrical impulse be provided to the speaker and thus speaker wire 24 provides this impulse. Both a ground and electrical impulse are carried by conductor 24; however, the ground lead is not extended to voice coil 38 since one end of coil 38 is grounded on cone unit 10. A terminal 26 is electrically connected with the conducting portion of wire 24 and is raised above the base or mounting flange 14 by a biasing spring 28. As shown in FIG. 1, the mounting flange 14 is grounded at 30 by direct attachment to one wire of conductor 24. Thus, when the cone unit 10 and base 12 are attached, the ground is transferred from the base to the cone unit 10.

The cone unit 10 is provided with a so-called carrier 34 which provides a rigid member for mounting speaker elements. Carrier 34 includes a first annular cutout 17 which receives base 12 and an annular cutout 36 which provides an open end extending toward coil carrier 15 and provides a receptacle to receive the voice coil 38. Coil 38 is wound onto coil carrier 15 and includes a number of windings of insulated, thin, wire which carry electrical impulses. One end of the voice coil 38 is grounded to the carrier 34 and thus when the cone 10 and base 12 are connected by means of the threads or the bayonet-type connection, a ground is provided to complete the electrical circuit for the speaker. The second end of the voice coil 38 extends through the carrier 34 and through the insulator 42 and is connected with a terminal member 43. For illustrative purposes the lead 40 is shown extending through the body of the carrier 34; however, it is well understood that any other type of convenient path could be used for connecting the one end of the voice coil 38 with its associated terminal 43.

A permanent magnet 46 surrounds the outer periphery of the carrier 34. Carrier 34 is a non-metallic or magnetically permeable member having a very low reluctance or interference with the paths of magnet lines of flux. Carrier 34 may be made of a permeable, soft iron which will hold magnet 46 in position yet not interfere with magnet interaction between magnet 46 and voice coil 38. Thus, a magnet circuit extends from magnet 46, through the adjacent part of carrier 34 and into the voice coil 36. When electrical impulses are flowing through coil 36 the coil becomes magnetized and will move up or down depending on the polarity (north or south) of the applied electrical impulse. Such movement of the coil also moves the attached coil carrier 15 and moves or vibrates the diaphragm 11 to produce an audible sound.

As shown in FIG. 1, a biasing spring 48 fits within cavity 18 and is compressed into the mounting flange 14 when the cone unit 10 is attached as shown in FIG. 2. When spring 48 is compressed it provides an upward force which provides the interconnected cone 10 and base 12 with a biasing force which tends to lock these two members securely in place. Thus, when the cone unit is screwed into the base or when the fingers 23 are inserted into their vertical slots **22*a* and horizontal bayonet-type grooves 22, spring 48** locks these two members securely into position and prevents the two members from inadvertently vibrating apart when in use or during transport.

Thus, it is shown by the foregoing that the two-piece speaker arrangement provided herein allows a multitude of speaker cones to be used with a single base 12. In the event it is desired to move the cone unit 10, it is simply unscrewed from the base, or, if the groove and finger arrangement 22, 23 is used, the cone is pushed toward the base 12 and then rotated slightly to clear the locking portion of the slot 22 and permit the base 12 to be removed from the cone 10.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A two piece speaker assembly, the improvement comprising:

a cone means including a flexible, lightweight diaphragm;

a base with means interconnecting the cone means with the base;

said cone means including a carrier having a pair of annular recesses extending in opposite directions and including a first recess providing a receptacle to receive a speaker coil;

a second annular recess including a fastening means;

said base including a cavity;

connecting means positioned adjacent said cavity on said base for cooperative engagement with the fastening means of the cone for securely and removably interconnecting the cone unit with the base;

said carrier of the cone unit including a circular magnet attached thereto and providing a magnetic field;

a coil carrier with means extending into the first annular cutout and having means for mounting said speaker coil thereto;

said diaphragm having means attached to the coil carrier and providing movable means for reciprocating movement in response to movement of the coil carrier;

electrical means for providing an electrical impulse to the speaker coil and moving the coil in said magnetic field to move the attached diaphragm and produce an audible sound.

2. The two piece speaker of claim 1 wherein the means interconnecting the cone means with the base includes:

first threaded means extending around an inside edge of the second annular recess;

second threaded means located in the cavity of the base including internal threads adapted to mate with the first threaded means of the cone means for attaching the cone means with the base.

3. The speaker assembly of claim 1 and:

said fastening means of the cone including finger means with means extending radially within the second annular recess;

said connecting means of the base member including vertical slot means and horizontal groove portions adapted to receive and securely hold an associated finger means of the cone unit.

4. The speaker assembly of claim 1 and:

spring means located in the cavity of the base unit and providing means adapted to bias and securely hold the together the cone unit and the base when both are fastened together.

5. The speaker assembly of claim 1 and:

said cone unit including a first terminal and electric wire means providing an electrical contact point between the voice coil and the terminal;

said base including a second terminal and insulator means associated with a cutout in the base;

spring biasing means located in the cutout and having means in contact with the insulator whereby as the spring biasing means is compressed, the cone means is fastened to the base to provide a contact force for supplying a connection to transmit an electrical signal to the speaker coil.

* * * * *